US005365210A

United States Patent [19]

Hines

[11] Patent Number: 5,365,210

[45] Date of Patent: Nov. 15, 1994

[54] LATCHING SOLENOID WITH MANUAL OVERRIDE

[75] Inventor: Marshall U. Hines, Scottsdale, Ariz.

[73] Assignee: AlliedSignal Inc., Morris Township, Morris County, N.J.

[21] Appl. No.: 124,918

[22] Filed: Sep. 21, 1993

[51] Int. Cl.[5] ..... H01F 7/08; H01F 7/00; H01H 9/00

[52] U.S. Cl. ..... 335/238; 335/237; 335/229; 335/173; 335/234

[58] Field of Search ..... 335/230, 173, 234, 236, 335/238, 253, 254, 237, 176, 229; 251/129

[56] References Cited

U.S. PATENT DOCUMENTS

| | | | |
|---|---|---|---|
| 2,220,813 | 11/1940 | Derungs . | |
| 2,395,164 | 5/1943 | Cole . | |
| 2,442,016 | 9/1945 | Poole . | |
| 2,690,529 | 2/1951 | Lindblad . | |
| 2,999,192 | 9/1961 | Lambert | 335/236 |
| 3,022,450 | 9/1958 | Chase . | |
| 3,070,730 | 8/1960 | Gray et al. . | |
| 3,113,251 | 2/1962 | Moser et al. . | |
| 3,673,529 | 6/1972 | Garratt et al. . | |
| 3,860,895 | 1/1975 | Chow et al. . | |
| 4,403,765 | 9/1983 | Fisher | 335/236 |
| 4,506,240 | 3/1985 | Shores et al. . | |
| 4,610,428 | 9/1986 | Fox . | |
| 5,223,812 | 6/1993 | Kreuter . | |

OTHER PUBLICATIONS

Pending Application (Docket No. 180-91-X41, U.S. Ser. No. 07/986,960), Filed Dec. 8, 1992, entitled "Solenoid Encasement with Variable Reluctance".

*Primary Examiner*—Leo P. Picard
*Assistant Examiner*—Stephen T. Ryan
*Attorney, Agent, or Firm*—Robert A. Walsh

[57] ABSTRACT

A latching solenoid device comprising an encasement, a portion of which is manually translatable in order to vary reluctance in a magnetic circuit which extends through the encasement, thereby providing the device with manual override capability.

4 Claims, 2 Drawing Sheets

LATCHING SOLENOID WITH MANUAL OVERRIDE

Reference is made to copending application Ser. No. 986,960 (hereinafter, the '960 application), which discloses and claims subject matter similar to that claimed in this application. All rights to both applications are owned by the same assignee.

TECHNICAL FIELD

This invention relates generally to solenoid devices such as linear electric motors and valves. More specifically, the invention relates to the encasement of such devices, wherein the encasement forms part of a magnetic circuit. Yet more specifically, the invention relates to a solenoid encasement adapted to provide variable reluctance in the circuit by linear movement of a portion of the encasement.

BACKGROUND OF THE INVENTION

Solenoid devices that use their encasement in magnetic circuits are widely known. An exemplary version is illustrated in U.S. Pat. No. 4,004,258 Arnold wherein the encasement 12 serves as a component of two magnetic circuits 19,21. Such devices are particularly useful as valve actuators in applications which demand a latching function. A problem in such applications is that if electrical power is lost in the system used to excite the coils of the solenoid device, the position of the armature (and, by extension, the position of the valve) is fixed and cannot easily be changed without restoration of power.

The '960 application solves the above-described problem by providing a solenoid encasement with variable magnetic reluctance. In the species illustrated in the '960 application, reluctance is varied by rotational movement of a portion of the encasement. The rotational movement effects linear movement of an associated valve stem from one latched position to another. The illustrated species is unnecessarily complicated in design, and relatively expensive to manufacture. The present invention is directed to providing a species of simpler design and lower cost. Other advantages of the invention may become apparent from the following description, which includes the appended claims and accompanying drawings.

SUMMARY OF THE INVENTION

The invention is a solenoid device having an encasement adapted to provide variable reluctance in a magnetic circuit which extends through the encasement, wherein the encasement comprises two or more relatively translatable members, the relative translation of which effects the variation in reluctance.

DESCRIPTION OF THE PREFERRED EMBODIMENT

Figure 1:
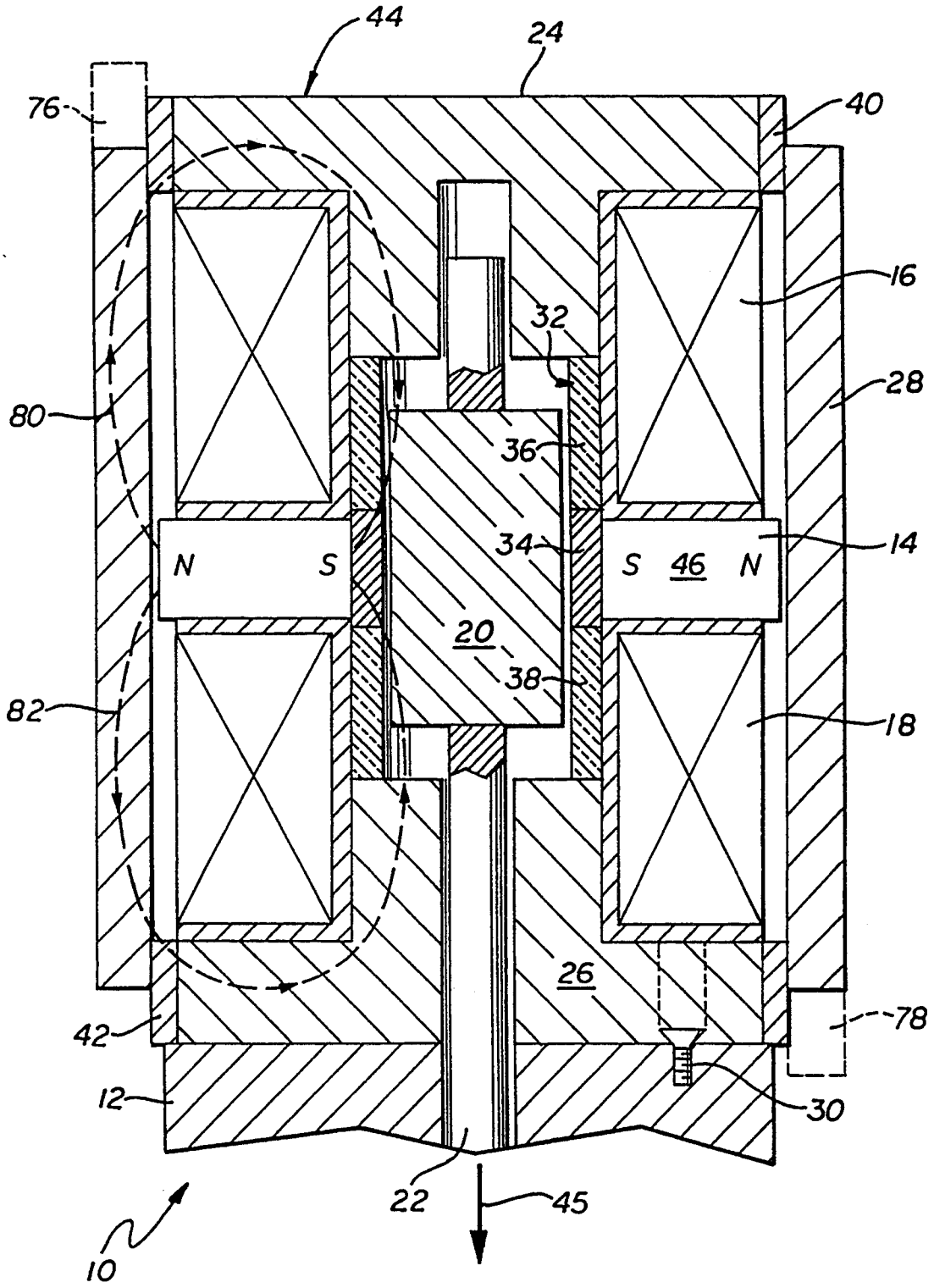
FIG. 1 is a sectional view, partially schematic, of a solenoid device incorporating the invention.

In FIG. 1, the number 10 designates a solenoid device that is shown attached to a valve body 12, the latter being only partially illustrated.

The interior of the solenoid 10 is comprised of a permanent magnet 14 interposed between two coils or windings 16, 18, and a ferromagnetic armature 20 typically connected to an actuating rod 22. In use, the armature 20 is moved to either of two latched positions in response to current flow through the respective coil. Accordingly, the armature 20 is illustrated in a position which it would occupy only transitorily in moving from one latched position to another. Leads for the coils 16, 18 extend to an external connector (not shown). The actuating rod 22 extends into the valve body 12 and in use opens or closes a valve as needed. Movement of the armature 20 is limited by upper and lower cylindrically-shaped, ferromagnetic stops 24, 26, which fix the forementioned latched positions.

Bolts (as at 30) extend through the lower stop 26 and fasten the entire solenoid 10 to the valve body 12. A canister 32 is formed by welding together a central ferromagnetic cylinder 34 and non-conductive cylinders 36, 38. The latter are welded to the respective stops 24,26 after insertion of the armature 20, and the coils 16, 18 are then wound onto their respective spools. Low-friction ferromagnetic bushings 40,42 are press-fitted onto the stops 24, 26.

The stops 24, 26 also serve as end pieces of an encasement 44. The encasement 44 is additionally comprised of a ferromagnetic sleeve or cylinder 28. The cylinder 28 circumscribes the core of the solenoid 10 and is translatable along the bushings 40, 42, and thus relative to the stops 24, 26. The cylinder 28 and stops 24, 26 collectively form a substantially cylindrical shape that defines a longitudinal axis 45.

The permanent magnet 14, generally conventional in design, is comprised of a plurality of corner-adjacent rectangular magnets (as at 46) secured in an annular aluminum cage (not shown). The magnet is unconventional in that at least one of the rectangular pieces (as at 48 in FIG. 2) has a socket 50 formed therein. The socket 50 receives a ball 52 formed on the end of a lever arm 54.

Figure 2:
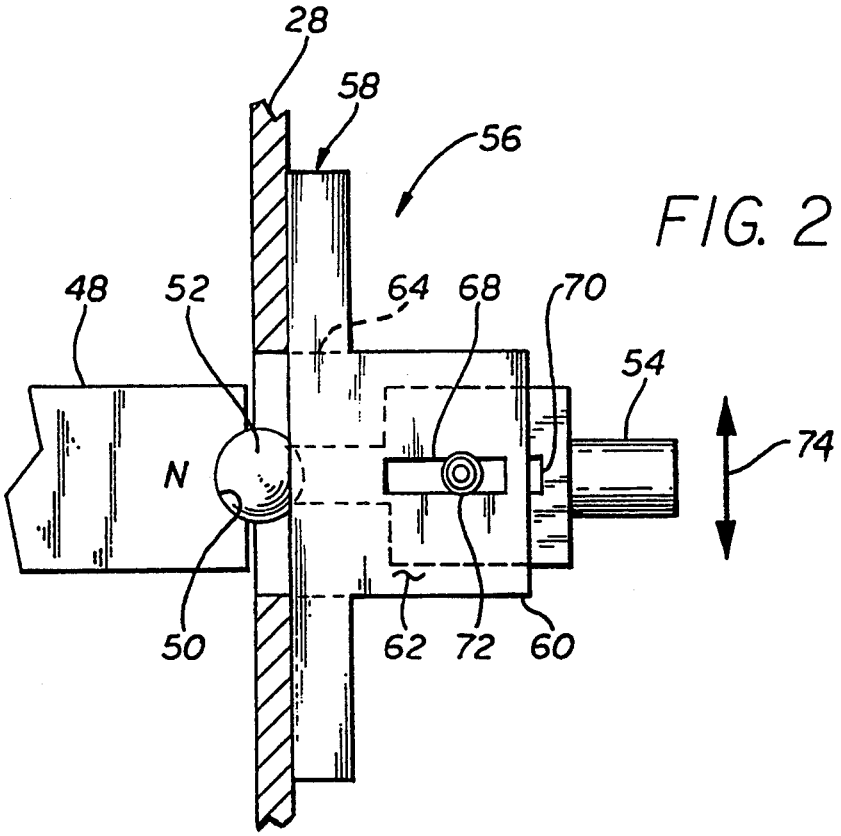
FIG. 2 is a partially sectional and partially elevational view illustrating a switching mechanism used in conjunction with the device of FIG. 1.
Figure 3A:
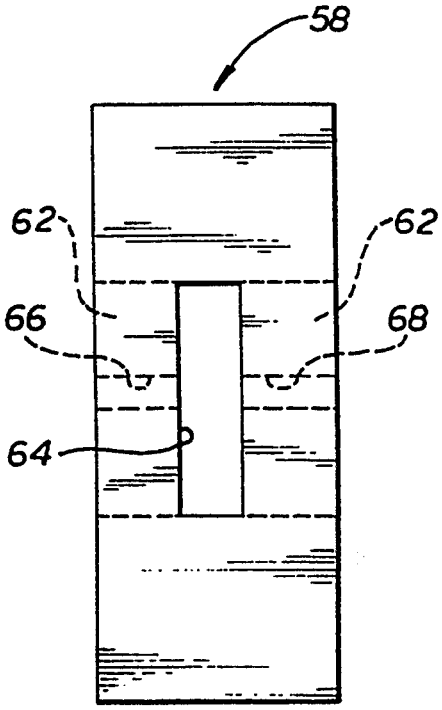
FIGS. 3*a* and 3*b* are elevational views of a block member also illustrated in FIG. 2.
Figure 3B:
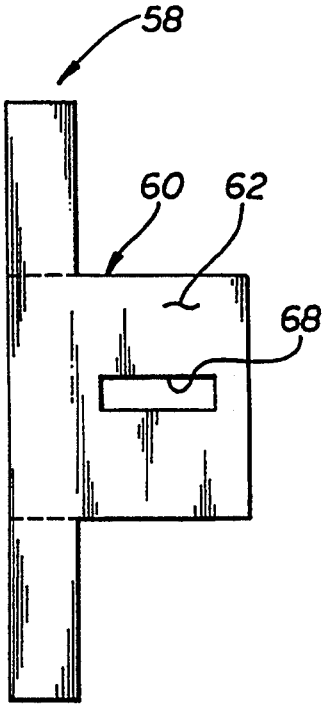

Turning now to FIGS. 2 and 3, the lever arm 54 is part of a switching mechanism 56 which, in the illustrated embodiment, includes a block member 58. The member 58 is rigidly connected to the cylinder 28 via weldments. The block member 58 includes a central portion 60 having two spaced walls (as at 62) which project from opposite sides of a rectangular slot 64 formed through the member. The central portion 60 has two aligned slots 66, 68 formed through the walls 62. The lever arm 54 has a slot 70 which is dimensionally equivalent to the aligned slots 66, 68. A flanged pin 72 extends through and is freely movable along the slots 66, 68, 70. The pin 72 connects the lever arm 54 to the block member 58. The ball 52 is captured between the socket 50 and the slot 64, extending partially into the latter.

Referring now to FIGS. 1 and 2, the lever arm 54 is movable in either of the two directions indicated by the arrow 74. Incident to such movement, the pin 72 moves to the left as seen in the drawing. In normal use of the device 10, the lever arm 54 occupies the position shown in FIG. 2, and movement of the armature 20 from one latched position to another is automatically controlled in a conventional manner by selected excitation of the coils 16, 18.

The magnetic circuits attributable to the permanent magnet 14 are illustrated by flux paths 80, 82. As seen in FIG. 1, the upper path 80 extends along and through the cylinder 28, through the bushing 40, stop 24, armature 20, conductive portion 34, and back to the magnet 14. Similarly, the lower path 82 extends along and through the cylinder 28, through the bushing 42, stop 26 armature 20, conductive portion 34, and back to the magnet 14. When the lever arm 54 is moved upward, the cylinder 28 is translated toward the position indicated by the dashed line 76 or, when the arm is moved downward, toward the position indicated by the dashed line 78. Incident to such movement, the contact area between the cylinder 28 and the bushings 40, 42 (respectively) is either decreased or eliminated, depending on the extent of the translation. Thus, if the cylinder 28 is moved upward, then flux density increases in the upper path 80 and decreases in the lower path 82. With no current flow through the coils 16, 18, such movement will cause the armature 20 to move upward until its movement is limited by the stop 24. The opposite result is obtained when the cylinder 28 is moved downward.

It will be understood from the above the foregoing description that the invention provides a solenoid device with the capability of manually overriding its last-occupied latched position in the event of a failure in the electrical power supply normally used to operate the device.

The foregoing portion of the description is intended to serve a pedagogical purpose, and is not intended to restrict the scope of the invention such that the scope is limited by details which are merely ancillary to the teaching contained herein.

What is claimed is:

1. Solenoid apparatus, comprising in combination:

an encasement including two relatively fixed end pieces interconnected with a movable portion; the encasement having a longitudinal axis and variable reluctance; the reluctance being variable by movement of the movable portion in a direction parallel to the longitudinal axis and relative to the end-pieces;

two spaced coils circumscribing the axis and secured in fixed relation to the end pieces;

a cylindrical armature coaxial with the encasement and disposed for axial movement between the end pieces;

a permanent magnet interposed between the coils and circumscribing the armature;

the encasement being interconnected with the magnet and coils whereby the movable portion is translatable in either of two directions along the axis.

2. Solenoid apparatus as recited in claim 1 further comprising switching means connected to the encasement for translating the movable portion in either of the two directions.

3. Solenoid apparatus as recited in claim 2 wherein the magnet is adapted to receive the switching means in interfacing relation.

4. Solenoid apparatus comprising in combination:

two spaced and coaxial coils;

a permanent magnet interposed between the coils;

encasement means for encasing the magnet and coils; the encasement means comprising first and second spaced and relatively stationary end pieces, and a sleeve member cooperating with the end pieces to form a generally cylindrical structure having a longitudinal axis; the structure cooperating with the magnet to form portions of first and second magnetic circuits; the first circuit extending through the first end piece and the sleeve member, and the second circuit extending through the second end piece and the sleeve member; the sleeve member being axially translatable relative to the end pieces in order to vary reluctance in the portions.

* * * * *